US005873014A

United States Patent [19]

Knapp et al.

[11] Patent Number: 5,873,014

[45] Date of Patent: Feb. 16, 1999

[54] SYSTEM FOR PURGING CONTAMINANTS FROM A VACUUM ASSISTED IMAGE CONDITIONING ROLL

[75] Inventors: John F. Knapp, Fairport; Lawrence Floyd, Jr., Rochester, both of N.Y.

[73] Assignee: Xerox Corporation, Stamford, Conn.

[21] Appl. No.: 4,463

[22] Filed: Jan. 8, 1998

[51] Int. Cl.[6] ..... G03G 15/10

[52] U.S. Cl. ..... 399/249; 15/256.52; 34/92; 34/95; 399/348

[58] Field of Search ..... 399/249, 348, 399/355, 237; 34/95, 92, 361; 15/256.52

[56] References Cited

U.S. PATENT DOCUMENTS

| | | | |
|---|---|---|---|
| 4,286,039 | 8/1981 | Landa et al. | 399/239 X |
| 4,990,962 | 2/1991 | Kishi | 399/249 X |
| 5,034,778 | 7/1991 | Levanon et al. | 399/249 |
| 5,332,642 | 7/1994 | Simms et al. | 399/250 X |
| 5,493,369 | 2/1996 | Sypula et al. | 399/240 |
| 5,752,144 | 5/1998 | Mammino et al. | 399/249 |
| 5,758,237 | 5/1998 | Abramsohn | 399/249 |

*Primary Examiner*—S. Lee

[57] ABSTRACT

A system for removing excess carrier liquid from an electrostatic image developed with liquid developing material made up of toner particles immersed in a liquid carrier medium on an image bearing member. The system includes an absorbent contact roller for absorbing at least a portion of the liquid carrier off of the liquid image, and vacuum source coupled to the contact roller for generating both negative pressure at the surface of the roller to draw the absorbed liquid through the contact roller, and positive air pressure for pushing contaminated liquid out of the roller.

24 Claims, 3 Drawing Sheets

SYSTEM FOR PURGING CONTAMINANTS FROM A VACUUM ASSISTED IMAGE CONDITIONING ROLL

This invention relates generally to a system for enhancing vacuum efficiency and effectiveness of a centrally evacuated permeable roller, and more particularly, concerns an improved vacuum assisted image conditioning device for removing excess liquid from a developed liquid image in a liquid developing material based electrostatographic printing machine.

Generally, the process of electrostatographic copying is initiated by exposing a light image of an original document onto a substantially uniformly charged photoreceptive member, resulting in the creation of a latent electrostatic image of the original document on the photoreceptive member. This latent image is subsequently developed into a visible image by a process in which developer material is deposited onto the surface of the photoreceptive member. Typically, this developer material comprises carrier granules having toner particles adhering triboelectrically thereto, wherein the toner particles are electrostatically attracted from the carrier granules to the latent image for forming a developed powder image on the photoreceptive member. Alternatively, liquid developing materials comprising a liquid carrier having toner particles immersed therein have been successfully utilized to develop electrostatic latent images, wherein the liquid developing material is applied to the photoconductive surface with the toner particles being attracted toward the image areas of the latent image to form a developed liquid image on the photoreceptive member. Regardless of the type of developing material employed, the toner particles of the developed image are subsequently transferred from the photoreceptive member to a copy substrate, either directly or by way of an intermediate transfer member. Thereafter, the image may be permanently affixed to the copy substrate for providing a "hard copy" reproduction or print of the original document or file. In a final step, the photoreceptive member is cleaned to remove any charge and/or residual developing material from the photoconductive surface in preparation for subsequent imaging cycles.

The above described electrostatographic reproduction process is well known and is useful for light lens copying from an original as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, known as DAD, or "write black" systems, as distinguished from so-called light lens generated image systems which develop toner on the charged areas, also known as CAD, or "write white" systems. The subject invention applies to both such systems.

The use of liquid developer materials in imaging processes is well known. Likewise, the art of developing electrostatographic latent images formed on a photoconductive surface with liquid developer materials is also well known. Indeed, various types of liquid developing materials and liquid based development systems have heretofore been disclosed with respect to electrostatographic printing machines. Liquid developers have many advantages, and often produce images of higher quality than images formed with dry developing materials. For example, the toner particles utilized in liquid developing materials can be made to be very small without the resultant problems typically associated with small particle powder toners, such as airborne contamination which can adversely affect machine reliability and can create potential health hazards. The use of very small toner particles is particularly advantageous in multicolor processes wherein multiple layers of toner generate the final multicolor output image. Further, full color prints made with liquid developers can be processed to a substantially uniform finish, whereas uniformity of finish is difficult to achieve with powder toners due to variations in the toner pile height as well as a need for thermal fusion, among other factors. Full color imaging with liquid developers is also economically attractive, particularly if surplus liquid carrier containing the toner particles can be economically recovered without cross contamination of colorants.

Liquid developer material typically contains about 2 percent by weight of fine solid particulate toner material dispersed in the liquid carrier, typically a hydrocarbon. After development of the latent image, the developed image on the photoreceptor may contain about 12 percent by weight of the particulate toner in the liquid hydrocarbon carrier. However, at this percent by weight of toner particles, developed liquid images tend to exhibit poor cohesive behavior which results in image smear during transfer. In addition, partial image removal, or so-called scavenging, is problematic during successive liquid development steps, particularly in image-on-image color processes. In order to prevent image scavenging and to improve the quality of transfer of the developed image to a copy sheet, the liquid developing material making up the developed liquid image is typically "conditioned" by compressing or compacting the toner particles in the developed image and removing carrier liquid therefrom for increasing the toner solids content thereof. This can be accomplished by either: conditioning the liquid ink making up the image into the image areas so as to physically stabilize the image on the photoreceptor or other image bearing surface; by conditioning liquid ink placed on the surface of the photoreceptor or other image bearing surface prior to the point where the image is developed with the liquid ink; or by conditioning the liquid ink stream as the ink is being delivered to the image bearing surface. Liquid ink conditioning greatly improves the ability of the toner particles to form a high resolution image on the final support substrate or an intermediate transfer member, if one is employed.

Various devices and systems are known for effectively conditioning liquid developing materials in electrostatographic systems. In one exemplary system particularly relevant to the present invention, a device and method for increasing the solid content of an image formed from a liquid developer is provided, wherein an absorbtive blotting material is contacted with the developed liquid image. A vacuum source is coupled to the blotting material so that absorbed liquid dispersant is drawn through the blotting material. The absorptive blotting material is preferably provided in the form of a covering on a porous conductive roller which is biased with an electrical charge having a polarity which is the same as the charge of the toner particles in the developing material, such that the resulting electric field repels the toner particles from the absorptive blotting material for transferring so that minimal toner particles thereto. The roller defines a central cavity to which the vacuum is coupled, forming a centrally evcuated permeable roller system.

Several advantages have been found in eliminating excess liquid carrier by vacuuming the liquid through a roller member, a belt, or other contact member. For example, in a vacuum assisted system, less dispersant evaporates into the atmosphere, thereby reducing pollution and potential health risks to individuals working near the machine. In addition, since the liquid carrier can be reclaimed and reused, an efficient vacuum assisted blotter roller can yield cost advantages. Furthermore, the use of a vacuum assisted system may eliminate the potential for removed liquid to return back to the image bearing surface from the contact member, thereby eliminating potential disturbance of the image such that the final output image tends to be more clearly defined.

Although various systems have been developed for conditioning an image in liquid based electrostatographic printing systems, some problems and inadequacies remain with respect to known electrostatically based systems. In particular, notwithstanding the use of electrical fields to repel toner particles from the absorption material, some toner particles, as well as other contaminants, such as paper debris and the like, may make their way into the absorption material. Thus, these systems tend to have a limited operational life due to clogging of pores within the absorption material, either by toner particles or contaminants which collect in the system.

The present invention is directed toward a system for enhancing vacuum efficiency and reducing contaminant entrapment in a vacuum assisted liquid removal system wherein a centrally evacuated permeable roller system is used to extract liquid from a wetted surface. More specifically, with respect to the field of liquid developing material-based electrostatographic copying and printing, the present invention is directed toward an electrostatic image conditioning device in which image compaction and liquid removal is accomplished via a porous roll member with the assistance of a vacuum system coupled thereto. In the particular invention disclosed herein, negative air pressure is generated within the porous roll member for drawing liquid carrier away from a developed liquid image on a photoreceptor or other image bearing surface, while positive air pressure is also generated for pushing liquid carrier and/or air through the porous roll member to purge the roll of contaminants therein. For purposes of the present discussion, negative air pressure will be defined as pressure between zero and the surrounding ambient environment, usually taken to be one atmosphere while positive air pressure will be defined as pressure greater than the surrounding ambient environment or greater than one atmosphere. The following disclosures may be relevant to some aspects of the present invention:

U.S. Pat. No. 4,286, 039

Patentee: Landa et al.

Issued: Aug. 25, 1981

U.S. Pat. No. 5,332,642

Patentee: Simms et al.

Issued: Jul. 26, 1994

U.S. Pat. No. 5,493,369

Patentee: Sypula et al.

Issued: Feb. 20, 1996

The relevant portions of the foregoing patents may be briefly summarized as follows:

U.S. Pat. No. 4,286,039 discloses an image forming apparatus comprising a deformable polyurethane roller, which may be a squeegee roller or blotting roller which is biased by a potential having a sign the same as the sign of the charged toner particles in a liquid developer. The bias on the polyurethane roller is such that it prevents streaking, smearing, tailing or distortion of the developed electrostatic image and removes much of the liquid carrier of the liquid developer from the surface of the photoconductor.

U.S. Pat. No. 5,332,642 discloses a porous roller for increasing the solids content of an image formed from a liquid developer. The liquid dispersant absorbed through the roller is vacuumed out through a central cavity of the roller. The roller core and/or the absorbent material formed around the core may be biased with the same charge as the toner so that the toner is repelled from the roller while the dispersant is absorbed.

U.S. Pat. No. 5,493,369 discloses a roller for improved conditioning of an image formed from a liquid developer comprised of toner particles and liquid carrier. A wire mesh uniformly covering an inner layer of the roller uniformly distributes an electrical bias closer to the surface of the roller and to the adjacent image bearing surface. The electrical bias has the same sign polarity as that of the toner particles of the image for electrostatically repelling the toner particles and preventing the toner particles from entering the roller, and for compacting the toner particles to the image. The wire mesh reduces the electrical requirements of the materials used for the roller.

In addition to the above cited references, it is noted that various techniques have been devised for removing excess liquid carrier from an imaging member which may involve a vacuum removal system and/or an electrical bias applied to a portion of the liquid dispersant removal device. The following additional references may be relevant:

U.S. Pat. No. 4,878,090 discloses a development apparatus comprising a vacuum source which draws air around a shroud to remove excess liquid carrier from the development zone.

U.S. Pat. No. 5,023,665 discloses an excess liquid carrier removal apparatus for an electrophotographic machine. The apparatus is comprised of an electrically biased electrode having a slit therein coupled to a vacuum pump. The vacuum pump removes, through the slit in the electrode, liquid carrier from the space between the electrode and the photoconductive member. The electrical bias generates an electrical field so that the toner particle image remains undisturbed as the vacuum withdraws air and liquid carrier from the gap.

U.S. Pat. No. 5,481,341 having a common assignee as the present application, discloses a belt used for absorbing liquid toner dispersant from a dispersant laden image on a electrostatographic imaging member or intermediate transfer member. The angle of contact of the absorption belt is adjusted with respect to the image bearing member for maintaining proper cohesiveness of the image and absorption of liquid dispersant. The absorption belt is passed over a roller biased with the same charge as the toner. A pressure roller is in contact with the absorption belt for removal of liquid therefrom.

U.S. Pat. No. 5,424,813, having a common assignee as the present application, discloses a roller comprising an absorption material and a covering, which are adapted to absorb liquid carrier from a liquid developer image. The covering has a smooth surface with a plurality of perforations, to permit liquid carrier to pass through to the absorption material at an increased rate, while maintaining a covering having a smooth surface which is substantially impervious to toner particles yet pervious to liquid carrier so as to inhibit toner particles from departing the image.

U.S. Pat. No. 5,481,341, having a common assignee as the present application, discloses a roller for controlling application of carrier liquid to form a liquid developed image, comprising a rigid porous electroconductive supportive core, a conformable microporous resistive foam material provided around the core, and a pressure controller for providing a positive or negative load pressure to the roller.

In accordance with one aspect of the present invention, there is provided a system for removing excess liquid from a liquid developed image having toner particles immersed in a liquid carrier on an image bearing surface, comprising: an absorbent contact member for contacting the liquid developed image on the image bearing member to absorb at least a portion of the liquid carrier therefrom; and a bi-directional vacuum system coupled to the absorbent contact member for selectively generating a negative pressure airflow through the absorbant contact member so as to draw absorbed liquid carrier therethrough and a positive pressure airflow through the absorbant contact member so as to push absorbed liquid carrier and residual contaminants from the absorbent contact member.

In accordance with another aspect of the present invention, a liquid ink type electrostatographic printing machine is provided, including a system for removing excess liquid from a liquid developed image having toner particles immersed in a liquid carrier on an image bearing surface, comprising: an absorbent contact member for contacting the liquid developed image on the image bearing member to absorb at least a portion of the liquid carrier therefrom; and a bi-directional vacuum system coupled to the absorbent contact member for selectively generating a negative pressure airflow through the absorbant contact member so as to draw absorbed liquid carrier therethrough and a positive pressure airflow through the absorbant contact member so as to push absorbed liquid carrier and residual contaminants from the absorbent contact member.

In accordance with yet another aspect of the invention, there is provided an improved vacuum assisted permeable roller system for removal of liquid from a wetted surface, comprising: a rigid porous core member and an absorbent contact layer for contacting the wetted surface to absorb at least a portion of the liquid therefrom; and a bidirectional vacuum system coupled to the permeable roller member for selectively generating a negative pressure airflow through the absorbant contact layer so as to draw absorbed liquid therethrough and a positive pressure airflow through the absorbant contact layer so as to push absorbed liquid and residual contaminants from the absorbent contact layer.

Other aspects of the present invention will become apparent as the following description proceeds and upon reference to the drawings, in which.

Figure 1:
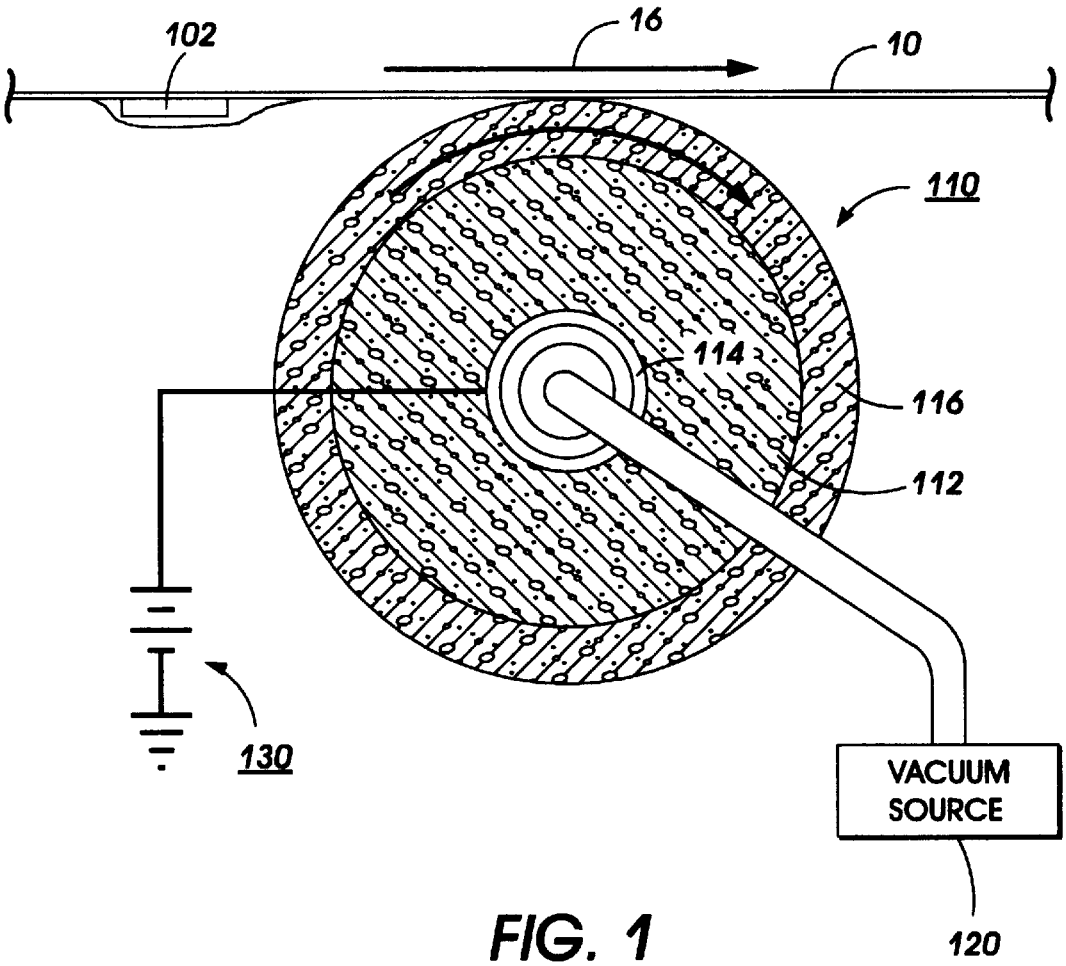
FIG. 1 is a schematic elevational view of an exemplary embodiment of a vacuum assisted image conditioning system for removing excess liquid from liquid developed images in accordance with the present invention.

For a general understanding of the features of the present invention, reference is made to the drawings, wherein like reference numerals have been used throughout to designate identical elements. FIG. 3 shows a schematic elevational view of a full-color, liquid developing material based electrostatographic printing machine incorporating the features of the present invention. Inasmuch as the art of electrostatographic printing is well known, the various processing stations employed in the printing machine of FIG. 2 will be described only briefly with reference thereto while the present description will focus on a detailed description of the particular features vacuum assisted image conditioning system of the present invention. It will become apparent from the following discussion that the apparatus of the present invention may also be well-suited for use in a wide variety of systems, devices, apparatus and machines and is not necessarily limited in its application to the field of electrostatographic printing or the particular liquid developing material-based electrostatographic machine described herein. As such, it will be understood that the presently described system and method provided by this invention, is not limited to use in printing engines but is capable of providing enhanced liquid removal from any wetted surface. As such, while the present invention will hereinafter be described in connection with preferred embodiments thereof, it will be understood that the description of the invention is not intended to limit the invention to this preferred embodiment. On the contrary, the description is intended to cover all alternatives, modifications, and equivalents as may be included within the spirit and scope of the invention as defined by the appended claims.

Turning now to FIG. 3, the multicolor electrostatographic printing machine shown employs a photoreceptive belt 10 which is transported in the direction of arrow 16, along a curvilinear path defined by rollers 12 and 14. These rollers are driven in the direction of arrows 13 for advancing successive portions of the photoreceptive belt 10 sequentially through the various processing stations disposed about the path of movement thereof. Initially, the belt 10 passes through a charging station where a corona generating device 20 charges the photoconductive surface of belt 10 to relatively high, substantially uniform electrical potential.

After the substantially uniform charge is placed on the photoreceptive surface of the belt 10, the printing process proceeds by either placing an input document from a transparent imaging platen (not shown), or by providing a computer generated image signal for discharging the photoconductive surface in accordance with the image information to be generated. The present description is directed toward a Recharge, Expose, and Develop (REaD) color imaging process, wherein the charged photoconductive surface of photoreceptive member 10 is serially exposed by a series of individual raster output scanners (ROSs) 22, 32, 42 to record a series of latent images thereon. The photoconductive surface is continuously recharged and re-exposed to record latent images thereon corresponding to the subtractive primary of another color of the original. Each latent image is serially developed with appropriately colored toner particles until all the different color toner layers are deposited in superimposed registration with one another on the photoconductive surface. It will be recognized that this REaD process represents only one of various multicolor processing techniques that may be used in conjunction with the present invention, and that the present invention is not intended to be limited to REaD processing or to multicolor processes.

Figure 2:
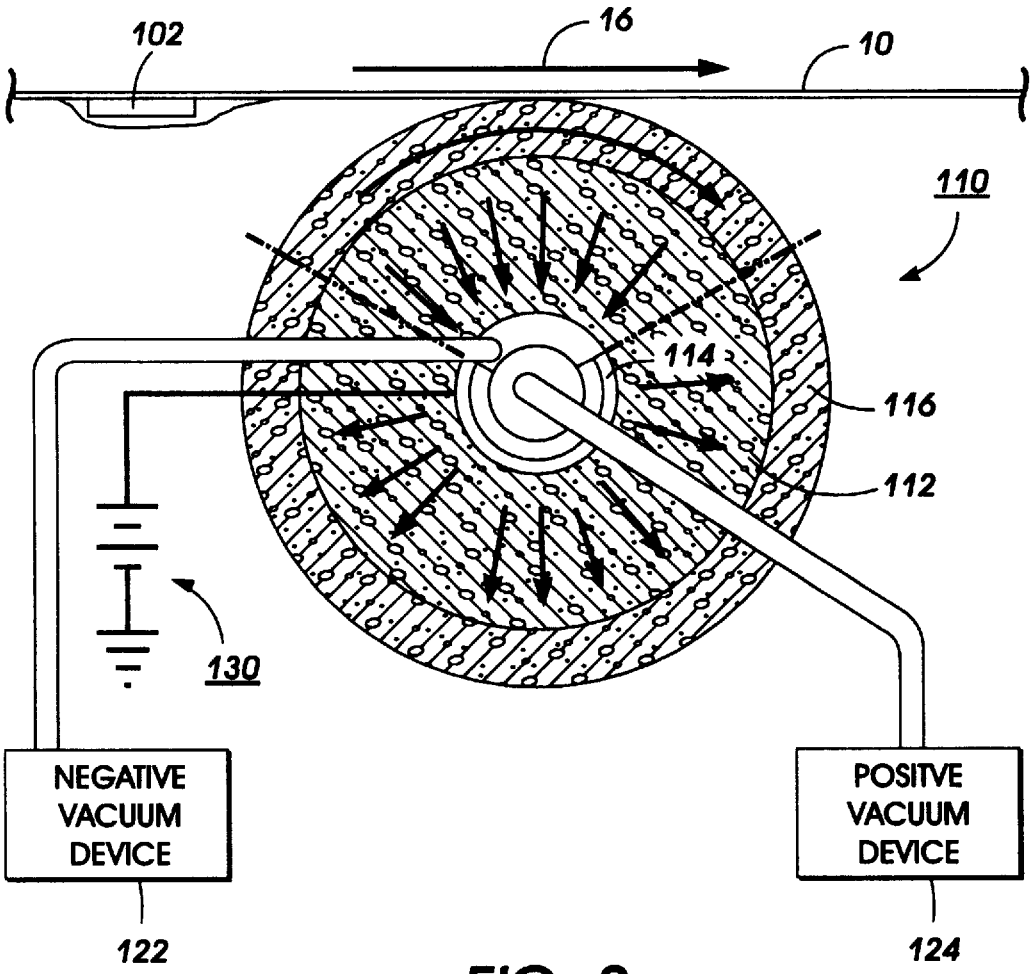
FIG. 2 is a schematic elevational view of an alternative embodiment for a vacuum assised, image conditioning system in accordance with the present invention.
Figure 3:
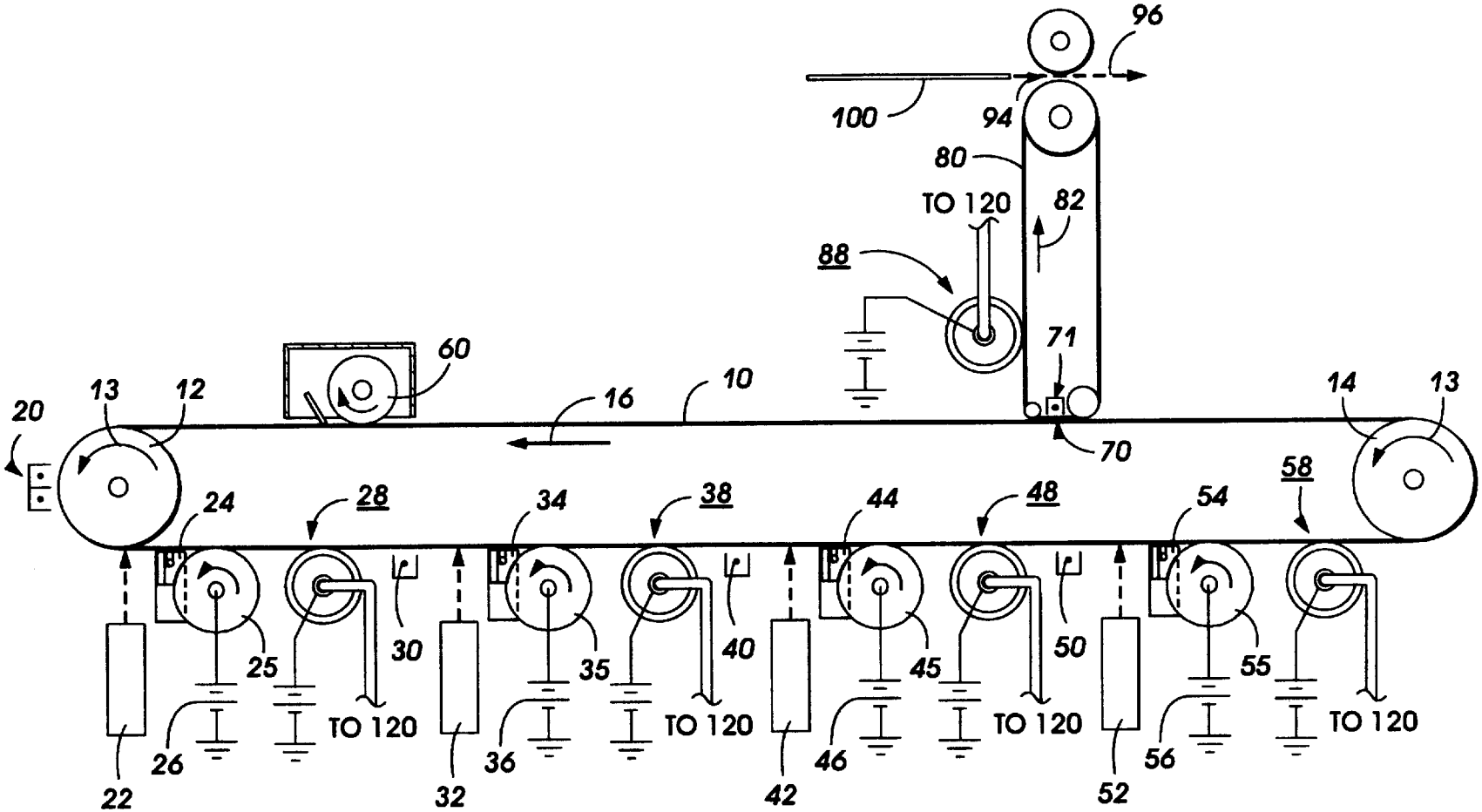
FIG. 3 is a schematic, elevational view of a liquid ink-based image-on-image color electrostatographic printing machine incorporating a vacuum assisted image conditioning system in accordance with the present invention.

In the exemplary electrostatographic system of FIG. 2, each of the color separated electrostatic latent images are serially developed on the photoreceptive belt 10 via a fountain-type developing apparatus 24, 34, 44 and 54, which may be of the type disclosed, for example in U.S. Pat. No. 5,579,473, wherein appropriately colored developing material is transported into contact with the surface of belt 10. Each different color developing material is comprised of charged toner particles disseminated through the liquid carrier, wherein the toner particles are attracted to the latent image areas on the surface of belt 10 by electrophoresis for producing a visible developed image thereon. Generally, in a liquid developing material-based system, the liquid carrier medium makes up a large amount of the liquid developing composition. Specifically, the liquid medium is usually present in an amount of from about 80 to about 98 percent by weight, although this amount may vary from this range.

By way of example, the liquid carrier medium may be selected from a wide variety of materials, including, but not limited to, any of several hydrocarbon liquids, such as high purity alkanes, including Norpar® 12, Norpar® 13, and Norpar® 15, and including isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, environmentally safe, and possess a sufficiently high vapor pressure so that a thin film of the liquid evaporates from the contacting surface within seconds at ambient temperatures. The toner particles can be any pigmented particle compatible with the liquid carrier medium, such as those contained in the developing materials disclosed in, for example, U.S. Pat. Nos. 3,729,419; 3,968,044; 4,476,210; 4,794,651; and 5,451,483, among numerous other patents. The toner particles preferably have an average particle diameter from about 0.2 to about 10 microns, and more precisely from about 0.5 to about 2 microns. The toner particles may be present in amounts of from about 1 to about 10 percent by weight, and preferably from about 1 to about 4 percent by weight of the developer composition. The toner particles can consist solely of pigmented particles, or may comprise a resin and a pigment; a resin and a dye; or a resin, a pigment, and a dye. Dyes generally are present in an amount of from about 5 to about 30 percent by weight of the toner particle, although other amounts may be present provided that the objectives of the present invention are achieved. Generally, any pigment material is suitable provided that it consists of small particles and that combine well with any polymeric material also included in the developer composition. Pigment particles are generally present in amounts of from about 5 to about 40 percent by weight of the toner particles, and preferably from about 10 to about 30 percent by weight. In addition to the liquid carrier vehicle and toner particles which typically make up the liquid developer materials suitable for use in a liquid developing material based electrostatographic machine, a charge control additive (sometimes referred to as a charge director) may also be included for facilitating and maintaining a uniform charge on toner particles by imparting an electrical charge of selected polarity (positive or negative) to the toner particles. The charge control additive may be present in an amount of from about 0.01 to about 3 percent by weight, and preferably from about 0.02 to about 0.05 percent by weight of the developer composition.

The developer station may also include a metering roll 25, 35, 45, 55 situated adjacent to a corresponding developer fountain 24, 34, 44, 54 and in close proximity to the surface of photoreceptive belt 10. The metering roll generally rotates in a direction opposite the movement of the photoconductor surface so as to exert a shear force on the liquid developed image in the area of the nip formed between the surface of the photoreceptor and the metering roll. This shear force removes an initial amount of liquid developing material from the surface of the photoreceptor so as to minimize the thickness of the developing material thereon. The excess developing material removed by the metering roll eventually falls away from the rotating metering roll for collection in a sump, not shown. A DC power supply 26, 36, 46, 56 may also be provided for maintaining an electrical bias on the metering roll at a selected polarity for enhancing image development. Each of the developer stations shown in FIG. 2 are substantially identical to one another and represent only one of various known apparatus or systems that can be utilized to apply liquid developing material to the photoconductive surface or other image recording medium.

After image development, it is generally desirable that the liquid developed image be processed or conditioned to compress the image and to remove additional excess liquid carrier therefrom, as shown, for example, by U.S. Pat. Nos. 4,286,039 and 5,493,369, among various other patents. This so-called "image conditioning" process is directed toward increasing the solids percentage of the image, and can advantageously increase the solids percentage of the image to a range of approximately 25% or higher. An exemplary apparatus for image conditioning is depicted at reference numerals 28, 38, 48 and 58, each comprising a roller member which preferably includes a porous body and a perforated skin covering. In addition, the image conditioning rolls 28, 38, 48 and 58 are typically conductive and biased to a potential having a polarity which repels the charged toner particles of the liquid developed image to compress the image and to inhibit the departure of toner particles therefrom. In an exemplary image conditioning system of U.S. Pat. No. 5,332,642, incorporated by reference herein, a vacuum source (not shown) may also be provided, coupled to the interior of the roller, for creating an airflow through the porous roller body to draw liquid carrier from the surface of the photoreceptor 10 for enhancing the process of increasing the percentage of toner solids in the developed image.

In operation, rollers 28, 38, 48 and 58 rotate in contact with the liquid image on belt 10 such that the porous body of roller 28 absorbs excess liquid from the surface of the image through the pores and perforations of the roller skin covering. The vacuum source draws liquid through the roller skin to a central cavity, wherein the collected liquid may be deposited in a receptacle or some other location which permits either disposal or recirculation of the liquid carrier. The porous roller is thus continuously discharged of excess liquid to provide constant removal of liquid from the developed image on belt 10. It will be recognized by one of skill in the art that the vacuum assisted liquid absorbing roller described hereinabove may also find useful application in an embodiment in which the image conditioning system is provided in the form of a belt, whereby excess liquid carrier is absorbed through an absorbent foam layer in the belt, as described in U.S. Pat. Nos. 4,299,902 and 4,258,115.

As previously noted, the present invention is directed toward an improved vacuum assisted image conditioning device, wherein the vacuum system coupled to the central cavity of the porous roller comprises a bidirectional vacuum source or sources for producing a vacuum arrangement that reduces the amount of contaminants residing in the roller, thereby yielding higher vacuum pressure in the critical area adjacent the developed liquid image on the photoreceptor and enhancing the operational life of the imaging conditioning roll. This improved vacuum assisted image conditioning apparatus, and a bidirectional vacuum arrangement in accordance therewith, will be described in detail following the present description of the electrostatographic printing process.

Moving on the with the discussion of illustrative multicolor printing process, imaging, development and image conditioning are repeated for subsequent color separations by recharging and reexposing the belt 10 via charging devices 30, 40 and 50 as well as exposure devices 32, 42 and 52, whereby color image information is superimposed over the previous developed image. For each subsequent exposure an adaptive exposure processing system may be employed for modulating the exposure level of the raster output scanner (ROS) 32, 42 or 52 for a given pixel as a function of the developing material previously developed at the pixel site, thereby allowing toner layers to be made independent of each other, as described in U.S. Pat. No. 5,477,317. The reexposed image is next advanced through a corresponding development station and subsequently through an associated image conditioning station, for processing in the manner previously described. Each step is repeated as previously described to create a multilayer image made up of black, yellow, magenta, and cyan toner particles as provided via each developing station. It should be evident to one skilled in the art that the color of toner at each development station could be provided in a different arrangement.

After the multilayer image is created on the photoreceptive member 10, it may be advanced to an intermediate transfer station 70 for transferring the image from the photoconductive belt 10 to an intermediate transfer member, identified by reference numeral 80. Thereafter, the intermediate transfer member continues to advance in the direction of arrow 82 to a transfer nip 94 where the developed image is transferred and affixed to a recording sheet 100 transported through nip 94 in the direction of arrow 96. While the image on the photoreceptor 10, after image conditioning thereof, and consequently the image transferred to the intermediate transfer member 80, has a solids percentage in the range of approximately 25%, the optimal solids content for transfer of a liquid image to a copy substrate is above approximately 50%. This solids percentage insures minimal hydrocarbon emissions from an image bearing copy substrate and further advantageously minimizes or eliminates carrier showthrough on the copy substrate. Thus, it is also desirable to remove excess liquid from the developed image on the intermediate 80, prior to transfer of that image to the copy sheet 100. To that end, prior to transfer of the image from the intermediate transfer member, the liquid developed image thereon may, once again, be conditioned in a manner similar to the image conditioning process described with respect to image conditioning apparatus 28, 38, 48 and 58. Thus, as shown in FIG. 2, an additional image conditioning apparatus 88 is provided adjacent the intermediate transfer member 80 for conditioning the image thereon.

Thereafter, transfer of the liquid developed image from the intermediate transfer member to the copy substrate 100 can be carried out by any suitable technique conventionally used in electrophotography, such as corona transfer, pressure transfer, bias roll transfer, and the like. It will be understood that transfer methods such as adhesive transfer, or differential surface energy transfer, wherein the receiving substrate has a higher surface energy with respect to the developing material making up the image, can also be employed.

After the developed image is transferred to intermediate member 80, residual liquid developer material may remain on the photoconductive surface of belt 10. A cleaning station 60 is therefore provided, which may include a roller formed of any appropriate synthetic resin which may be driven in a direction opposite to the direction of movement of belt 10, for scrubbing the photoconductive surface clean. It will be understood, however, that a number of photoconductor cleaning devices exist in the art, any of which would be suitable for use with the present invention. In addition, any residual charge left on the photoconductive surface may be extinguished by flooding the photoconductive surface with light from a lamp (not shown) in preparation for a subsequent successive imaging cycle. In this way, successive electrostatic latent images may be developed.

The foregoing discussion provides a general description of the operation of a liquid developing material based electrostatographic printing machine which may advantageously incorporate the improved bi-directional or bilateral vacuum assisted image conditioning system of the present invention. The detailed structure of the improved bilateral vacuum assisted image conditioning system will be described hereinafter with reference to FIG. 1.

Referring now to FIG. 1 a preferred embodiment of the the bi-directional vacuum assisted image conditioning system for purging contaminants from a vacuum assisted image conditioning role in accordance with the present invention will be described, with an understanding that the image conditioning systems shown in the multicolor electrostatographic printing system of FIG. 3, identified by reference numerals 28, 38, 48, 58 and 88, are substantially identical thereto. In general, the only major distinction between each image conditioning system is the liquid developed image being conditioned, with minor distinctions possibly being found in spacing and bias voltage levels due to developed image pile height differences.

FIG. 1 depicts one of various embodiments for a vacuum assisted image conditioning system in accordance with the present invention, which generally includes a porous roll member 110 in the form of an absorbent cylindrical contact roller coupled to a vacuum system 120. The roll member 110 is positioned adjacent to an image bearing surface 10 which transports a developed liquid image 102 into contact therewith for removing at least a portion of the liquid carrier from the liquid image 102. A high voltage bias supply 130 may also be provided, for biasing the roll member 110 to the same polarity as that of the toner particles in the developed liquid image so that the toner particles are electrostatically repelled away from the surface of the roll member 110. This electrical bias may also act to electrostatically compact the image on the image bearing 10, enabling physical stabilization of the toner particles within the developed liquid image area. One exemplary vacuum assisted porous roller system known in the art which may be effectively used to condition an image formed of a liquid developing material is generally disclosed in commonly assigned U.S. Pat. No. 5,332,642, previously incorporated herein by reference, wherein a negative pressure vacuum system is coupled to an absorbent blotter roller to draw off liquid carrier dispersant through the absorbent material which, in turn, removes excess carrier liquid from the developed liquid image.

Describing this vacuum assisted liquid removal apparatus in greater detail, roll member 110 is generally comprised of a rigid porous support core 114 which may be in the form of a cylindrical tube defining a hollow central cavity extending along the entire length of the roller 110. A conformable, preferably microporous, absorbent material, which may include a permeable skin covering 116, surrounds the support core 114 for contacting the wetted surface from which liquid is to be removed. Vacuum source 120 is coupled to the central cavity of the porous support core 114 for generating air and fluid flow therethrough, extending through the absorbent material layer 112 and the permeable skin 116 to the exterior of the roller member 110. In normal operation, the vacuum source 120 draws liquid carrier that has permeated into the absorbent material of roller member 110 toward the central cavity of the support core 114.

Porous support core 114 may be made from a sintered metal, plastic, ceramic or other rigid material having sufficient rigidity and porosity for being urged against the liquid developed image while allowing airflow therethrough. In addition, the material is preferably made to be electroconductive, either by itself or in combination with another conductive material, such that the electrical bias provided by supply 130 can be applied thereto to produce an electrical field which results in a repelling force against the toner particles in the image area.

The conformable microporous absorbent material making up roller 110 is preferably characterized by an open cell material which may comprise an absorbent polymeric and/or elastomeric foam material with conductive filler or dissipative filler incorporated therein. This material has a hardness preferably from 20 to 60 Shore A, and has a thickness of 1.0 mils to 500 mils, preferably, about 40 mils to 250 mils. The absorption material of the microporous roller may be any suitable material, preferably a foam such as one selected from the group consisting of Polyurethane, Silicone, Fluorocarbon, Polyimide, Melamine, and rubber, such as Permair® (a microporous polyurethane material available from Porvair Ltd., England), and Textratex® (a microporous semipermeable fluorocarbon membrane available from Tetratec Corp., Pennsylvania). Preferably, the absorbent material is also electroconductive so that the electric field created by the bias source 130 applied to the core 114 is uniformly distributed along the surface of the roll member 110 and the adjacent image bearing surface. A suitable level of resistivity for the absorbent material is in the range of 105 to 1011 ohm-cm, and is preferably in the range of 106 to 109 ohm-cm.

The open cell pores of the absorbent material generally may be less than 1,000 microns in diameter, and preferably should be in the range of about 5 to about 300 microns, although various applications outside of the field of electrostatographic printing may certainly contemplate the use of pore sizes outside of these limits. Moreover, in the case of liquid developing material based electrostatographic applications, very small pores of one micron or less may be used to absorb liquid carrier from an image, resulting in a requirement for increased vacuum pressure necessary to extract an equivalent amount of liquid as that of a roller having larger size pores. Preferably, the porous absorbent layer is substantially impervious to toner particles while being pervious to liquid carrier for inhibiting the departure of toner particles from the image. An exemplary absorbent roller having a rigid porous electroconductive support core and a conformable microporous roller is described in commonly assigned U.S. Pat. No. 5,481,341, the relevant portions of which are hereby incorporated herein by reference. It is understood, however, that various and numerous materials known in the art may be satisfactorily used to meet the strength, porosity and conductivity requirements of the liquid extraction system of the present invention. The materials must, of course, be compatible with whatever liquid material is being removed.

In operation, roll member 110 rotates in contact with surface 10 (or 80) to encounter the "wet" image. The absorbent layer 112 of roller 110 absorbs excess liquid from the surface of the image through the porous skin covering 116, with the excess liquid permeating into the absorbent layer via capillary action. Vacuum source 120 is coupled to one end of the central cavity defined by core 114, generating negative pressure for drawing liquid that has permeated into the absorbent layer toward the central cavity to transport the liquid to a receptacle or some other location which will allow for either disposal or recirculation of the liquid carrier. Thus, porous roller 110, being continuously discharged of excess liquid, provides continuous absorption of liquid from the image on surface 10. This process conditions the image by reducing the liquid content thereof while providing an increase in percent solids in the developed image, thereby improving the quality of the developed image.

While the vacuum system 120 assists in drawing liquid carrier through the absorbent material of the roll member 110 and into a central cavity thereof, where it may then be removed to a collection location, the vacuum system pressure must be carefully selected so as to remove only liquid carrier from the image and so as to not have excessive suction force capable of also affecting the toner particles from the image. It has been found that vacuum pressures ranging from about 0.5 inches of water to greater than 45 inches of water, and preferably within the range of 1.0 to about 15 inches of water have been suitable in electrostatographic applications. It is noted that capillary action in the porous roll helps initiate the movement of fluid through the roll and the assistance of the vacuum source 120 provides the continued fluid motion toward the central cavity thereof.

Problematically, however, notwithstanding the careful selection and/or adjustment of negative air pressure provided by the vacuum source 120, it is not uncommon that loosely attached toner particles as well as other contaminants such as paper debris, dust particles, and the like will be drawn into the pores of the roller member 110. While some of these contaminants will be drawn all the way into the central cavity and removed from the system without causing any problems, it has been found that some contaminants and toner particles may build up in the pores of the roller member 110, which, in turn, may result in the loss of absorption functionality, and may further result in image degradation.

The present invention provides a solution to the problem described above by providing positive air pressure for reversing the flow of liquid carrier through the roll member 110. The reverse flow purges the roll member 110 of toner particles and other contaminants built up in the pores thereof. Thus, in accordance with the present invention, the vacuum source 120 also provides positive air pressure to core 114 for pushing liquid carrier and residual contaminants therein away from the core 114 and out of the absorbent material 112, as well as the permeable skin 116, to purge contaminants therefrom, as will be described in further detail.

The concept of the present invention may be implemented in various ways. In the simplest approach, the vacuum source 120 can include a first, negative pressure, vacuum generator and a second, positive pressure, vacuum generator. In this embodiment, the positive pressure vacuum generatore is periodically energized to generate a flow of liquid away from the central cavity of the roller member, as desired. Preferably, periodic energization of the positive pressure vacuum generator can be systematically initiated so as not to impact the printing process. For example, the periodic energization of the positive pressure vacuum can be implemented between print runs, at machine shut down, or during a preprogrammed preventive maintenance cycle.

In an alternative embodiment, vacuum source 120 may be comprised of a bidirectional vacuum system wherein the same vacuum mechanism can be utilized to produce both positive and negative pressure airflow. In the case of the bi-directional vacuum device, positive pressure airflow is preferably periodically and systematically generated, as desirable.

In another alternative embodiment of the present invention, as illustrated in FIG. 2, core 114 is provided in the form of a segmented member which allows rotation of the absorbent layer 112 and skin covering 116 thereabout. In this embodiment, dual vacuum sources are provided, with a negative pressure vacuum source 122 being coupled to a segment of core 114 associated with that portion of the roll member 110 adjacent image bearing surface 10, while a positive pressure vacuum source 124 is coupled to a segment of core 114 associated with a portion of the roll member 110 not adjacent the image bearing surface 10. This embodiment permits opposing vacuum pressures to be delivered to selected localized areas of the roll member 110 depending on whether that area of the roll member is adjacent or not adjacent to the liquid image. In this embodiment, both the positive and negative pressure vacuum devices 122 and 124 may be continuously energized such that the roll member 110 may continuously draw liquid and be purged of liquid as the roll member 110 rotates.

In review, the present invention provides a system for purging contaminants and enhancing the vacuum efficiency in a permeable vacuum assisted roll system used to remove liquid from a wetted surface. In particular, the system provides enhanced image conditioning of a liquid developed image being delivered to or on an image bearing surface in a liquid ink based electrostatographic printing machine, particularly an image-on-image type multicolor machine. The image conditioning system includes an absorbent contact roll member having a vacuum source coupled thereto adapted to draw fluid through the absorbent roll member and also to push fluid out of the roll member to purge contaminants therefrom.

It is, therefore, apparent that there has been provided, in accordance with the present invention, a system for purging contaminants and enhancing the vacuum efficiency in a centrally evacuated permeable roller system for liquid removal from a wetted surface and particularly for conditioning liquid images on an image bearing surface in a liquid ink type multicolor electrostatographic printing machine, particularly an image-on-image type multicolor machine. The method and apparatus described herein fully satisfies the aspects of the invention hereinbefore set forth. While this invention has been described in conjunction with specific embodiments thereof, it is evident that many alternatives, modifications and variations will be apparent to those skilled in the art. Accordingly, it is intended to embrace all such alternatives, modifications, and variations as fall within the spirit and broad scope of the appended claims.

We claim:

1. A system for removing excess liquid from a liquid developed image having toner particles immersed in a liquid carrier on an image bearing surface, comprising:

an absorbent contact member for contacting the liquid developed image on the image bearing surface to absorb at least a portion of the liquid carrier therefrom;

a bi-directional vacuum system coupled to said absorbent contact member for selectively generating a negative pressure airflow through said absorbant contact member so as to draw absorbed liquid carrier therethrough and a positive pressure airflow through said absorbant contact member so as to push absorbed liquid carrier and residual contaminants from said absorbent contact member.

2. The system of claim 1, wherein said absorbent contact member is a roller member having a first portion adjacent the image bearing surface and a second portion not adjacent the image bearing surface, including a rigid porous core defining a central cavity having said bi-directional vacuum system coupled thereto; and a porous absorbent material layer surrounding said rigid porous core.

3. The system of claim 2, further including a permeable skin covering said porous absorbent material layer.

4. The system of claim 1, further including an electrical biasing source coupled to said contact member for providing an electrical bias thereto having a polarity similar to a polarity of the toner particles to generate an electric field for electrostatically repelling and compressing the toner particles towards the image bearing surface.

5. The system of claim 1, wherein said bi-directional vacuum system includes:

a first vacuum generating device for generating negative pressure; and a second vacuum generating device for generating positive pressure.

6. The system of claim 5, further including means for selectively periodically energizing said first and second vacuum generating devices.

7. The system of claim 2, wherein said bi-directional vacuum system includes:

a single vacuum generating device for producing a first negative pressure airflow through said porous absorbent material layer, and a second, negative positive pressure airflow through said porous absorbent material layer.

8. The system of claim 7, further including means for selectively energizing said vacuum generating device to periodically produce the negative and positive pressure airflow through said porous absorbent material layer.

9. The system of claim 2, wherein:

said rigid porous core includes a segmented member which allows rotation of said porous absorbent material layer thereabout, said segmented member including a first portion associated with the portion of said roller member adjacent the image bearing surface and a second portion associated with the portion of said roller member not adjacent the image bearing surface; and said bi-directional vacuum system includes a dual vacuum source having a negative pressure vacuum generator, and a positive pressure vacuum generator; wherein the negative pressure vacuum generator is coupled to the first portion of the segmented member associated with the portion of said roller member adjacent the image bearing surface, and the positive pressure vacuum generator is coupled to the second portion of said roller member associated with the portion of said roller member not adjacent the image bearing surface for permitting opposing vacuum pressures to be delivered to selected localized areas of said roller member.

10. A liquid developing material based electrostatographic printing machine including a system for removing excess liquid from a liquid developed image having toner particles immersed in a liquid carrier on an image bearing surface, comprising:

an absorbent contact member for contacting the liquid developed image on the image bearing surface to absorb at least a portion of the liquid carrier therefrom;

a bi-directional vacuum system coupled to said absorbent contact member for selectively generating a negative pressure airflow through said absorbant contact member so as to draw absorbed liquid carrier therethrough and a positive pressure airflow through said absorbant contact member so as to push absorbed liquid carrier and residual contaminants from said absorbent contact member.

11. The system of claim 10, wherein said absorbent contact member is a roller member having a first portion adjacent the image bearing surface and a second portion not adjacent the image bearing surface, including a rigid porous core defining a central cavity having said bi-directional vacuum system coupled thereto; and a porous absorbent material layer surrounding said rigid porous core.

12. The system of claim 11, further including a permeable skin covering said porous absorbent material layer.

13. The system of claim 10, further including an electrical biasing source coupled to said contact member for providing an electrical bias thereto having a polarity similar to a polarity of the toner particles to generate an electric field for electrostatically repelling and compressing the toner particles towards the image bearing surface.

14. The system of claim 10, wherein said bi-directional vacuum system includes:

a first vacuum generating device for generating negative pressure; and a second vacuum generating device for generating positive pressure.

15. The system of claim 14, further including means for selectively periodically energizing said first and second vacuum generating devices.

16. The system of claim 11, wherein said bi-directional vacuum system includes:

a single vacuum generating device for producing a negative pressure airflow through said porous absorbent material layer, and a positive pressure airflow through said porous absorbent material layer.

17. The system of claim 16, further including means for selectively energizing said vacuum generating device to periodically produce the negative and positive pressure airflow through said porous absorbent material layer.

18. The system of claim 11, wherein:

said rigid porous core includes a segmented member which allows rotation of said porous absorbent material layer thereabout, said segmented member including a first portion associated with the portion of said roller member adjacent the image bearing surface and a second portion associated with the portion of said roller member not adjacent the image bearing surface; and said bi-directional vacuum system includes a dual vacuum source having a negative pressure vacuum generator, and a positive pressure vacuum generator; wherein the negative pressure vacuum generator is coupled to the first portion of the segmented member associated with the portion of said roller member adjacent the image bearing surface, and the positive pressure vacuum generator is coupled to the second portion of said roller member associated with the portion of said roller member not adjacent the image bearing surface for permitting opposing vacuum pressures to be delivered to selected localized areas of said roller member.

19. An improved vacuum assisted permeable roller system for removal of liquid from a wetted surface, comprising:

a rigid porous core member and an absorbent contact layer for contacting the wetted surface to absorb at least a portion of the liquid therefrom; and a bi-directional vacuum system coupled to said permeable roller system for selectively generating a negative pressure airflow through said absorbant contact layer so as to draw absorbed liquid therethrough and a positive pressure airflow through said absorbant contact layer so as to push absorbed liquid and residual contaminants from said absorbent contact layer.

20. The improved vacuum assisted permeable roller system of claim 19, wherein said bi-directional vacuum system includes:

a first vacuum generating device for generating negative pressure; and a second vacuum generating device for generating positive pressure.

21. The system of claim 20, further including means for selectively periodically energizing said first and second vacuum generating devices.

22. The system of claim 19, wherein said bi-directional vacuum system includes:

a single vacuum generating device for producing a negative pressure airflow through said absorbent contact layer, and a positive pressure airflow through said absorbent contact layer.

23. The system of claim 22, further including means for selectively energizing said vacuum generating device to periodically produce the negative and positive pressure airflow through said absorbent contact layer.

24. The system of claim 19, wherein:

said rigid porous core member includes a segmented member which allows rotation of said absorbent contact layer thereabout, said segmented member including a first portion associated with a portion of said absorbent contact layer adjacent the wetted surface and a second portion associated with a portion of said member absorbent contact layer not adjacent the wetted surface; and said bi-directional vacuum system includes a dual vacuum source having a negative pressure vacuum generator, and a positive pressure vacuum generator; wherein the negative pressure vacuum generator is coupled to the first portion of the segmented member associated with the portion of said absorbent contact layer adjacent the wetted surface, and the positive pressure vacuum generator is coupled to the second portion of said absorbent contact layer associated with a portion of said absorbent contact layer not adjacent the wetted surface for permitting opposing vacuum pressures to be delivered to selected localized areas of said absorbent contact member.

* * * * *